US006749459B2

(12) United States Patent
Urbaniak et al.

(10) Patent No.: US 6,749,459 B2
(45) Date of Patent: Jun. 15, 2004

(54) ELECTRICAL CONNECTION SYSTEM

(75) Inventors: Andreas Urbaniak, Muenster (DE); Robert Koch, Korschenbroich (DE); Tarik Guenay, Neuss (DE)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/185,833

(22) Filed: Jun. 27, 2002

(65) Prior Publication Data

US 2003/0013341 A1 Jan. 16, 2003

(30) Foreign Application Priority Data

Jul. 10, 2001 (GB) ..... 0116810

(51) Int. Cl.[7] ..... H01R 12/24
(52) U.S. Cl. ..... 439/496; 439/368
(58) Field of Search ..... 439/496, 495, 439/354, 367, 368

(56) References Cited

U.S. PATENT DOCUMENTS

| | | | | | |
|---|---|---|---|---|---|
| 3,941,448 | A | * | 3/1976 | Evans | 439/496 |
| 5,462,453 | A | | 10/1995 | Muller | 439/570 |
| 5,775,930 | A | | 7/1998 | Model et al. | 439/352 |
| 6,071,153 | A | | 6/2000 | Fink et al. | 439/752 |
| 6,077,124 | A | * | 6/2000 | Etters et al. | 439/496 |
| 6,142,813 | A | | 11/2000 | Cummings et al. | 439/374 |
| 6,162,085 | A | | 12/2000 | Chugh et al. | 439/467 |
| 6,168,445 | B1 | | 1/2001 | Seutschniker et al. | 439/157 |
| 6,171,146 | B1 | | 1/2001 | Fink et al. | 439/595 |
| 6,176,746 | B1 | | 1/2001 | Morello et al. | 439/718 |
| 6,179,658 | B1 | | 1/2001 | Gunay et al. | 439/587 |
| 6,203,364 | B1 | | 3/2001 | Cupak et al. | 439/527 |
| 6,210,186 | B1 | | 4/2001 | Fink et al. | 439/157 |
| 6,213,795 | B1 | | 4/2001 | Drescher et al. | 439/157 |
| 6,247,965 | B1 | | 6/2001 | Cummings et al. | 439/587 |
| 6,276,960 | B1 | | 8/2001 | Schaefer et al. | 439/522 |
| 6,305,957 | B1 | | 10/2001 | Fink et al. | 439/157 |
| 6,338,651 | B1 | | 1/2002 | Svette, Jr. et al. | 439/559 |
| 6,361,356 | B1 | | 3/2002 | Heberlein et al. | 439/489 |
| 6,379,162 | B1 | | 4/2002 | Raypole et al. | 439/92 |
| 6,383,033 | B1 | | 5/2002 | Politsky et al. | 439/686 |
| 6,406,307 | B2 | | 6/2002 | Bungo et al. | 439/130 |
| 6,416,119 | B1 | | 7/2002 | Gericke et al. | 296/205 |
| 6,422,881 | B1 | | 7/2002 | Puhl et al. | 439/140 |
| 6,485,318 | B1 | | 11/2002 | Schoepf | 439/187 |
| 6,485,337 | B2 | | 11/2002 | Hsieh | 439/845 |
| 6,494,751 | B1 | | 12/2002 | Morello et al. | 439/752 |
| 6,508,666 | B1 | | 1/2003 | Francis | 439/548 |
| 6,527,573 | B2 | | 3/2003 | Stein, Sr. et al. | 439/260 |
| 6,533,611 | B2 | | 3/2003 | Morello et al. | 439/595 |
| 6,537,099 | B2 | | 3/2003 | Herlinger et al. | 439/352 |
| 6,547,605 | B2 | | 4/2003 | Daugherty et al. | 439/686 |
| 6,565,372 | B2 | | 5/2003 | Bakker et al. | 439/157 |
| 6,607,393 | B2 | | 8/2003 | Raypole et al. | 439/92 |

* cited by examiner

*Primary Examiner*—Javaid H. Nasri
(74) *Attorney, Agent, or Firm*—David P. Wood

(57) ABSTRACT

An electrical connection system (100) for a substantially flat electrical conductor (3) comprising housing means (8) having an axially extending bore (32); an electrical connector (102) having a body (1) capable of making a sliding fit in the axial direction (A) in the bore; securing means (7,11) on the housing means and the body for releasably securing the body in a predetermined position in the bore; wherein the body of the electrical connector further comprises a rear wall (20) for receiving the flat conductor; a through bore (28) extending from the rear wall through the body in the axial direction through which the flat conductor can pass; an upper contact surface (24) extending in the axial direction away from the inner opening (28') of the through bore, the upper contact surface having an area (13) capable of exerting a force on the flat conductor in a direction substantially perpendicular to the axial direction and away from the upper contact surface; a front edge (22) adjacent the upper contact surface around which the flat conductor can bend; and a lower surface (26) having fastening means (4) for securing a free end (12) of the flat conductor. Provides a connection system for an FPC or FFC without the use of terminals on the connector.

21 Claims, 5 Drawing Sheets

ELECTRICAL CONNECTION SYSTEM

The benefit of the filing date of GB Provisional Patent Application 0116810.3 filed Jul. 10, 2001 is claimed.

TECHNICAL FIELD

The present invention relates to an electrical connection system in which at least one of the connectors has no electrical terminals. The present invention is particularly for making an electrical connection with a flexible printed circuit (FPC) or flat flexible circuit (FFC).

BACKGROUND OF THE INVENTION

Known FPC/FFC connectors have a design which is similar to the usual round cable/wire connectors with terminals. These terminals are crimped or soldered onto the FPC/FFC. This is necessary for both parts (female and male) of a two-part connector, with different terminals (female/male) for each part. These terminals fit in cavities of each connector. Crimped or soldered connections are unsuitable for FPC/FFC.

SUMMARY OF THE INVENTION

It is an object of the present invention to overcome the above mentioned problem.

An electrical connection system in accordance with the present invention for a substantially flat electrical conductor comprises housing means having an axially extending bore; an electrical connector having a body capable of making a sliding fit in the axial direction in the bore; securing means on the housing means and the body for releasably securing the body in a predetermined position in the bore; wherein the body of the electrical connector further comprises a rear wall for receiving the flat conductor; a through bore extending from the rear wall through the body in the axial direction through which the flat conductor can pass; an upper contact surface extending in the axial direction away from the inner opening of the through bore, the upper contact surface having an area capable of exerting a force on the flat conductor in a direction substantially perpendicular to the axial direction and away from the upper contact surface; a front edge adjacent the upper contact surface around which the flat conductor can bend; and a lower surface having fastening means for securing a free end of the flat conductor.

The present invention enables the realization of a connection between two FPC/FFC's without any electrical terminals on the electrical connector, and uses a simple housing. This provides the possibility of using the present invention for service or repair of a damaged FPC/FFC. The present invention may also be used for making an electrical connection between an FPC/FFC and an electrical header having electrical terminals.

The potential benefits of the present invention include cost saving through reduction of numbers of parts, tools and the modular use; shorten production and assembly process; performance improvement through easier tool design and better handling; and wide range of use through flexible and modular construction.

BRIEF DESCRIPTION OF THE DRAWINGS

The present invention will now be described, by way of example, with reference to the accompanying drawings, in which.

DESCRIPTION OF PREFERRED EMBODIMENT

Figures 1, 2:
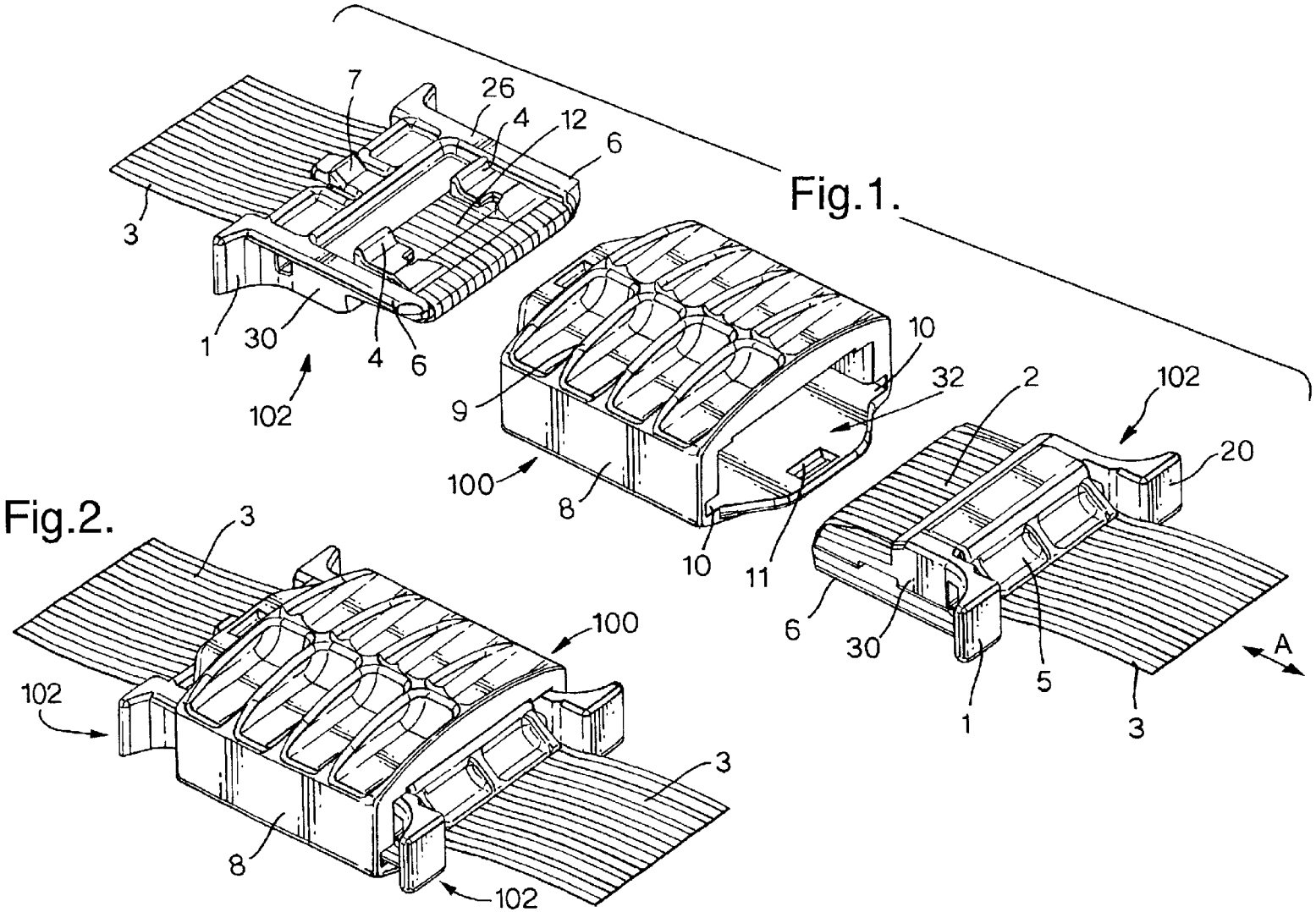
FIG. 1 is an exploded perspective view of a first embodiment of electrical connection system in accordance with the present invention.
FIG. 2 is a perspective view of the connection system of FIG. 1 in the fully mated position.
Figure 3:
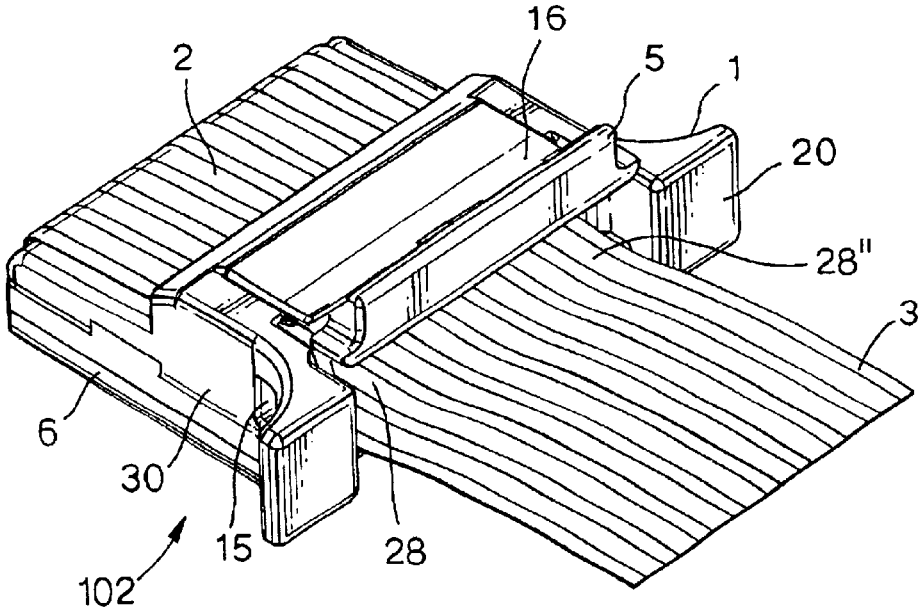
FIG. 3 is a perspective view of one of the electrical connectors of the connection system of FIG. 1 prior to clamping to the FFC.

Referring to FIGS. 1 to 4, the first embodiment of electrical connection system 100 essentially comprises three parts—first and second electrical connectors 102, which are substantially identical; and a housing 8. Each connector 102 has an insulating (plastics) body 1 to which an FFC (or FPC) 3 is clamped, as described in more detail below. The housing 8 is also formed from insulating (plastics) material and receives the connectors 102 to mate the FFCs 3.

Figure 4:
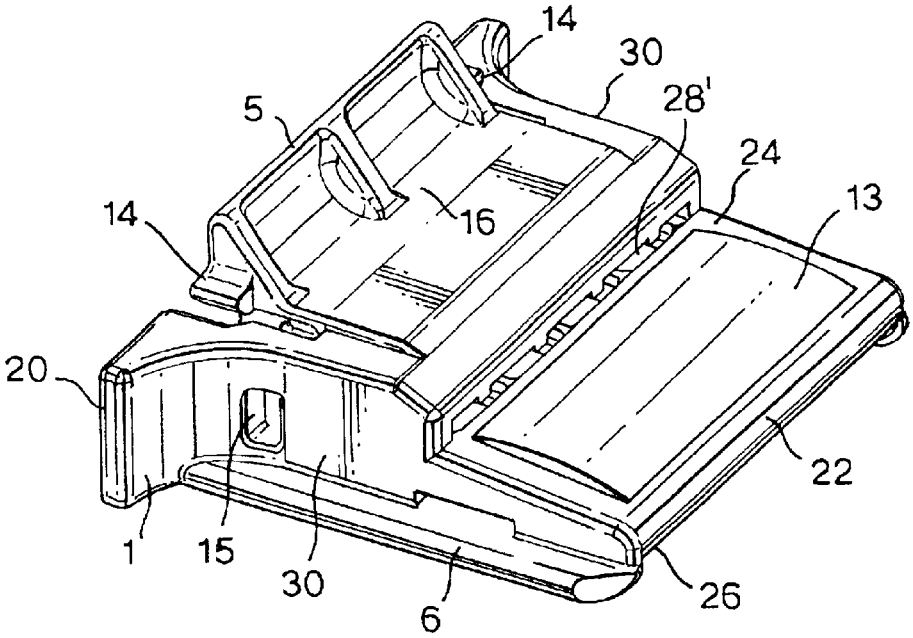
FIG. 4 is a perspective view of one of the electrical connectors of the connection system of FIG. 1 prior to insertion of the FFC.
Figure 4A:
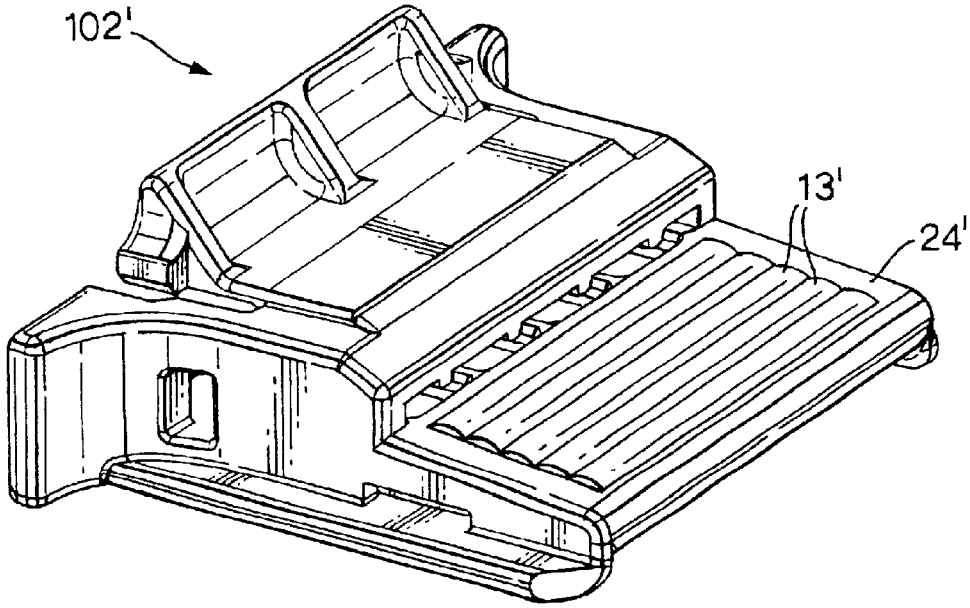
FIGS. 4*a* and 4*b* are perspective views of alternative embodiments for the electrical connector of FIG. 4.
Figure 4B:
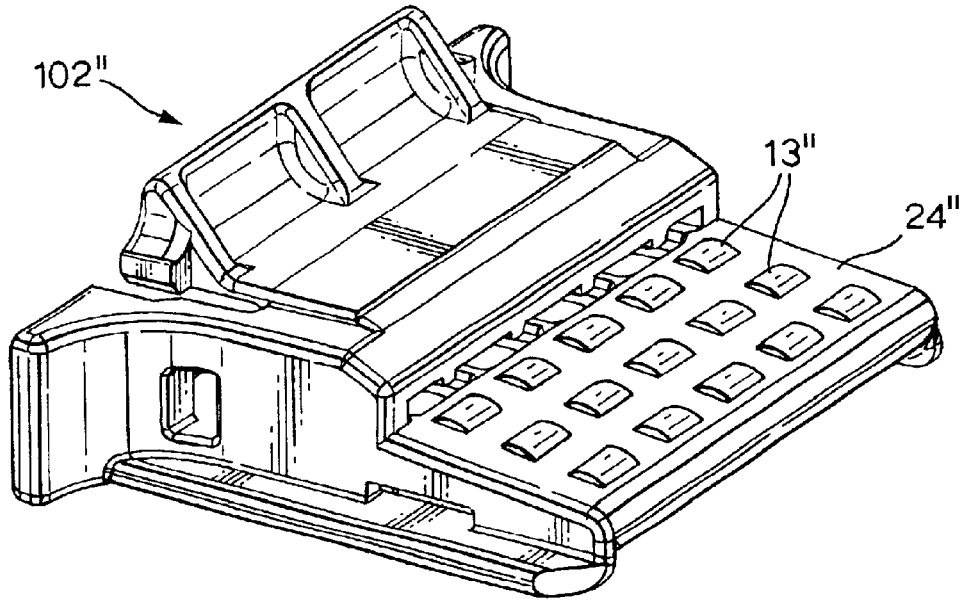
Figure 5:
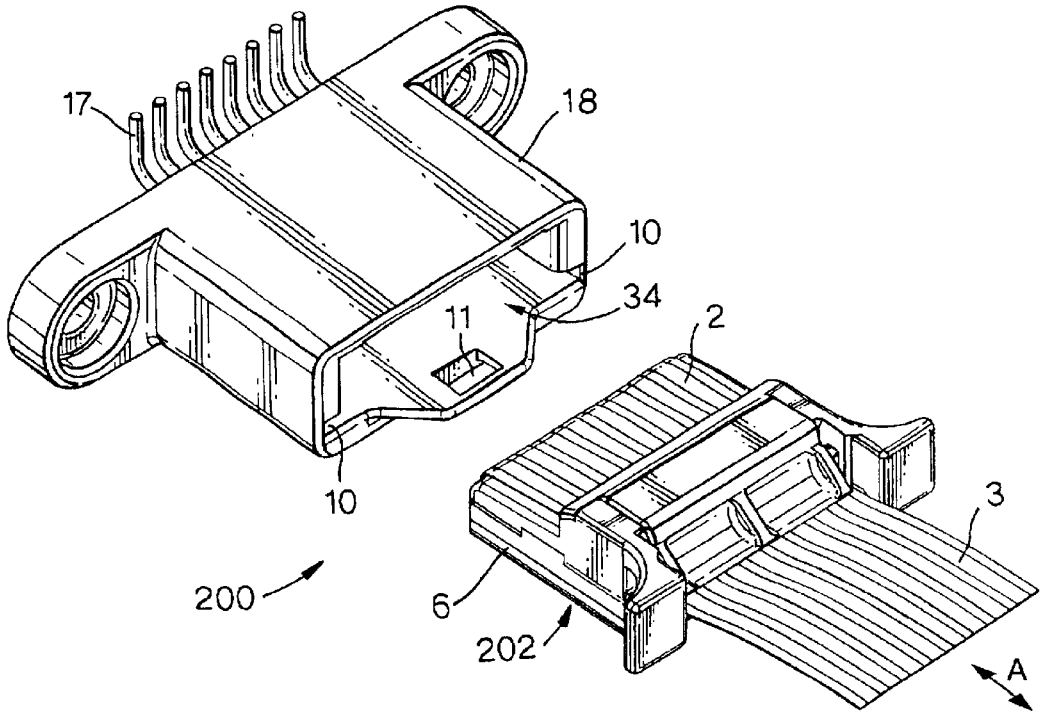
FIG. 5 is an exploded perspective view of a second embodiment of electrical connection system in accordance with the present invention.
Figure 6:
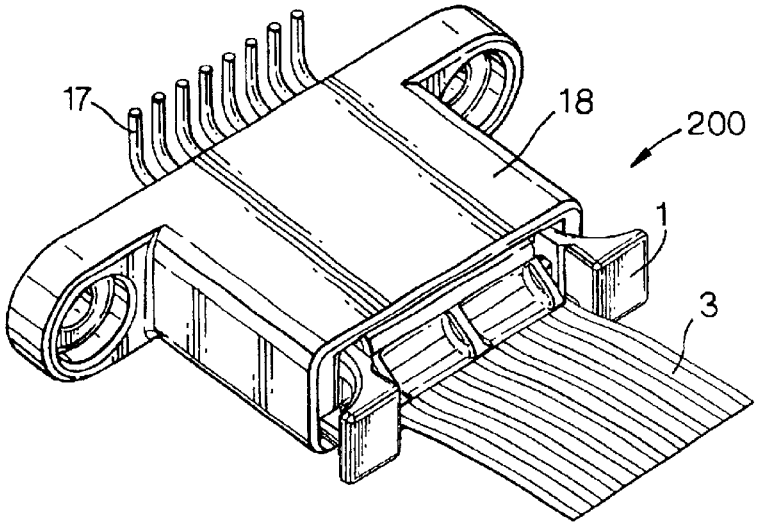
FIG. 6 is a perspective view of the connection system of FIG. 5 in the fully mated position.
Figure 7:
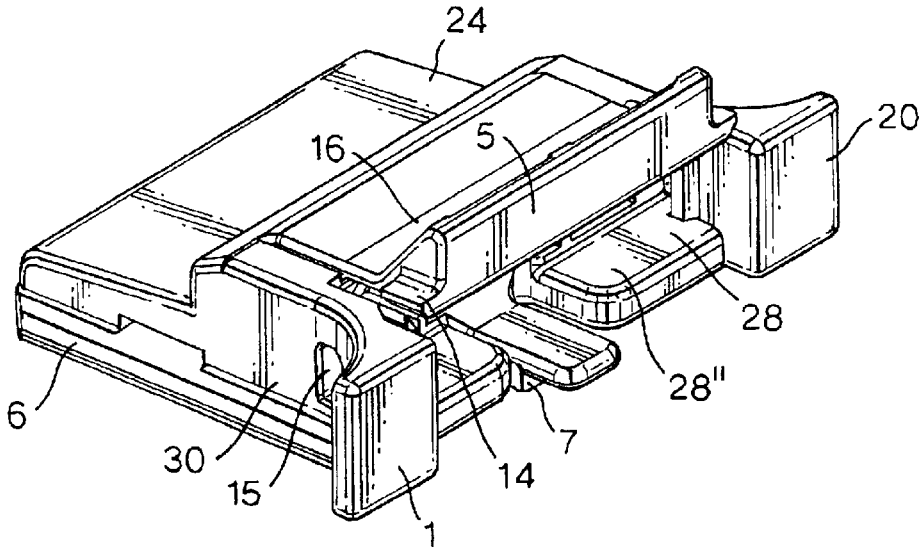
FIG. 7 is a rear perspective view of the electrical connector of the connection system of FIG. 5 prior to insertion of the FFC.
Figure 8:
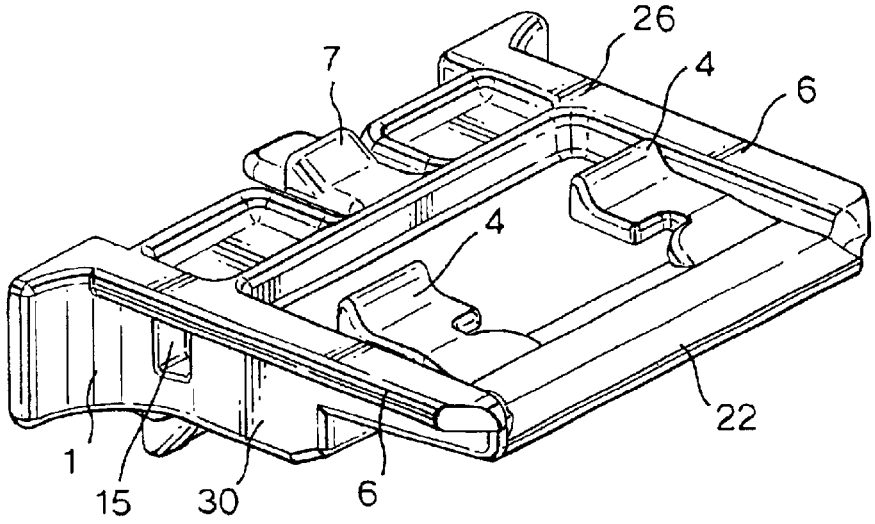
FIG. 8 is a front perspective view of the electrical connector of FIG. 7.
Figure 9:
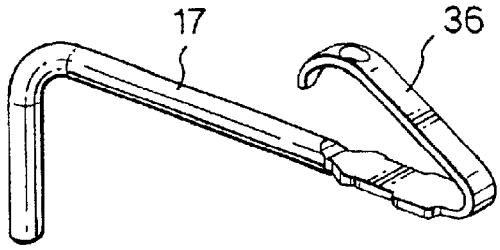
FIG. 9 is a perspective view of one of the electrical terminals of the header of the connection system of FIG. 5.

The body 1 of each connector 102 comprises a rear wall 20, a front edge 22, an upper contact surface 24, and a lower surface 26. The body 1 has a through bore 28 which extends in an axial direction A, and which has an outer opening 28" in the rear wall 20, and an inner opening 28' which opens adjacent the upper surface 24. The FFC 3 passes through the through bore 28, extends across the upper contact surface 24, is bent around the front edge 22, and is secured to the lower surface 26. The free end 12 of the FFC 3 is cut to be substantially T-shaped and is secured beneath a pair of hooks 4 formed in the lower surface 26. Other arrangements for securing the free end 12 of the FFC 3 to the lower surface 26 may be used. The FFC 3 is also secured to the body 1 by a fixation member 5 which is attached to the body 1 at the rear wall 20 by a hinge 16. After insertion of the FFC 3, the fixation member 5 is pivoted until tabs 14 on the member 5 make a snap fit in corresponding windows 15 formed in the side edges 30 of the body 1. The fixation member 5 also provides strain relief for the FFC 3. The upper contact surface 24 of the body 1 has a contact area 13, which may be separately formed (of a different material), to exert a force on the FFC 3 in a direction substantially perpendicular to the axial direction A, to increase the contact pressure on mating. As shown in FIG. 4, the contact area 13 may be substantially convex in shape. Alternatively, the contact area may be formed with rows of resilient bumps 13', 13" (as shown in FIG. 4*a* or FIG. 4*b* respectively). The conductors of the portion 2 of the FFC 3 adjacent the contact area 13 are exposed for electrical connection on mating. Each side edge 30 of the body 1 has an axially extending rib 6. The lower surface 26 of the body 1 has a latch arm 7 formed therein adjacent the rear wall 20.

The housing 8 is substantially tubular with a bore 32 extending therethrough for receiving the connectors 102.

Axially extending slots 10 are formed in the inner surface of the housing 8 for slidably receiving the ribs 6 on the bodies 1 of the connectors 102. When the connectors 102 are in predetermined position (the fully mated position) in the bore 32 in the housing 8, the latch arms 7 on the connector bodies 1 make a snap fit in windows 11 formed in the housing 8. Ribs 9 may be formed in the housing 8 to increase the strength thereof.

For mating, one of the connectors 102 is slid into the bore 32 in the housing 8 from one end thereof, and the other connector is slid into the bore from the other end thereof but with a reversed orientation. In the fully mated position, the upper contact surfaces 24 of each connector 102 are adjacent and facing one another. The exposed conductors of the portion 2 of the FFC 3 secured to one connector 102 are therefore pushed into engagement with, and electrically connect with, the exposed conductors of the portion 2 of the FFC 3 secured to the other connector 102 due to the force exerted by the contact areas 13 on each upper contact surface 24. The present invention therefore provides a system 100 for electrically connecting FFCs (and FPCs) 3 without the need for electrical terminals in either of the connectors 102.

Referring to FIGS. 5 to 9, the second embodiment of electrical connection system 200 essentially comprises two parts—an electrical connector 202; and an electrical header (housing means) 18. The electrical connector 202 is substantially identical to the electrical connectors 102 of FIGS. 1 to 4, and like parts have been given the same reference numeral.

The electrical header 18 has a bore 34 for receiving the electrical connector 202 is a sliding fit. Axially extending slots 10 are formed in the inner surface of the header connector 18 for slidably receiving the ribs 6 on the connector body 1 of the electrical connector 202. When the electrical connector 202 is a predetermined position (the fully mated position) inside the header 18, the latch arm 7 on the connector body 1 makes a snap fit in a window 11 formed in the header 18. Electrical terminals 17 are secured to the header 18 and have a resilient contact surface 36 positioned in the bore 34.

For mating, the electrical connector 202 is pushed into the bore 34 in the header 18. In the fully mated position, the exposed conductors of the portion 2 of the FFC 3 secured to the electrical connector 202 engage and electrically connect with the contact surfaces 36 of the terminals 17. The present invention therefore provides a system 200 for electrically connecting FFCs (and FPCs) 3 to terminals of a header without the need for electrical terminals in the electrical connector 202.

Having thus described the invention, it is claimed:

1. An electrical connection system for a substantially flat electrical conductor comprising:

housing means having an axially extending housing bore;

an electrical connector having a body capable of making a sliding fit in the axial direction in the housing bore; and securing means on the housing means and the body for releasably securing the body in a predetermined position in the bore; wherein the body of the electrical connector further comprises a rear wall for receiving the flat conductor, a through bore through which the flat conductor can pass, an upper contact surface, a front edge around which the flat conductor can bend, and a lower surface, the through bore extending from an outer opening in the rear wall through the body in the axial direction to an inner opening the upper contact surface extending in the axial direction away from the inner opening of the through bore, the upper contact surface having an area capable of exerting a force on the flat conductor in a direction substantially perpendicular to the axial direction and away from the upper contact surface; the front edge being located between the upper contact surface and the lower surface, and the lower surface having fastening means for securing a free end of the flat conductor, and wherein a fixation member is attached to the rear wall to releasably apply a clamping force to the flat conductor.

2. An electrical connection system as claimed in claim 1, wherein the securing means comprises a latch arm on the body of the electrical connector, and a corresponding window formed in the housing means.

3. An electrical connection system as claimed in claim 2, wherein the fastening means comprises a pair of hooks.

4. An electrical connection system for a substantially flat electrical conductor comprising:

housing means having an axially extending housing bore;

an electrical connector having a body capable of making a sliding fit in the axial direction in the housing bore; and securing means on the housing means and the body for releasably securing the body in a predetermined position in the housing bore, the securing means comprising a latch arm on the body of the electrical connector and a corresponding window formed in the housing means, wherein the body of the electrical connector further comprises a rear wall for receiving the flat conductor, a through bore through which the flat conductor can pass, an upper contact surface, a front edge around which the flat conductor can bend, and a lower surface, the through bore extending from an outer opening in the rear wall through the body in the axial direction to an inner opening, the upper contact surface extending in the axial direction away from the inner opening of the through bore, the upper contact surface having an area capable of exerting a force on the flat conductor in a direction substantially perpendicular to the axial direction and away from the upper contact surface, the front edge being disposed adjacent the upper contact surface and located between the upper contact surface and the lower surface, the lower surface having fastening means comprising a pair of hooks for securing a free end of the flat conductor, wherein the electrical connection system further comprising a fixation member attached to the rear wall by a hinge, and positioned adjacent the outer opening of the through bore, the fixation member being pivotable between a first position in which the fixation member can apply a clamping force on the flat conductor, and a second position in which the fixation member applies no clamping force.

5. An electrical connection system as claimed in claim 4, further comprising an axially extending rib on the body of the electrical connector, and a corresponding axially extending slot in the housing bore, the rib making a sliding fit in the slot.

6. An electrical connection system as claimed in claim 5, wherein the area on the upper contact surface is substantially convex.

7. An electrical connection system as claimed in claim 5, wherein the area on the upper contact surface comprises rows of resilient bumps.

8. An electrical connection system as claimed in claim 5, wherein the area on the upper contact surface is formed of a different material to the body of the electrical connector.

9. An electrical connection system as claimed in claim 8, wherein the housing means is substantially tubular with the housing bore being open at either end, wherein the system comprises two electrical connectors which are substantially identical, wherein the body of one electrical connector makes a sliding fit in the housing bore from one end thereof, and wherein the body of the other electrical connector makes a sliding fit in the housing bore from the other end thereof in a reverse orientation to the body of said one electrical connector such that the respective areas of the upper contact surfaces are positioned adjacent one another when each electrical connector is in its predetermined position.

10. An electrical connection system as claimed in claim 9, further comprising electrical terminals secured in the housing means, each terminal having a resilient contact surface such that the resilient contact surfaces are positioned adjacent the area of the upper contact surface when the electrical connector is in its predetermined position.

11. An electrical connection system as claimed in claim 1, wherein the fastening means comprises a pair of hooks.

12. An electrical connection system for a substantially flat electrical conductor comprising:

housing means having an axially extending housing bore;

an electrical connector having a body capable of making a sliding fit in the axial direction in the housing bore;

securing means on the housing means and the body for releasably securing the body in a predetermined position in the housing bore; wherein the body of the electrical connector further comprises a rear wall for receiving the flat conductor, a through bore through which the flat conductor can pass, an upper contact surface, a front edge around which the flat conductor can bend, and a lower surface, the through bore extending from an outer opening in the rear wall through the body in the axial direction to an inner opening, the upper contact surface extending in the axial direction away from the inner opening of the through bore, the upper contact surface having an area capable of exerting a force on the flat conductor in a direction substantially perpendicular to the axial direction and away from the upper contact surface; the front edge being disposed adjacent the upper contact surface and located between the upper contact surface and the lower surface, and the lower surface having fastening means for securing a free end of the flat conductor, wherein the electrical connection system further comprising a fixation member attached to the rear wall by a hinge, and positioned adjacent the outer opening of the through bore, the fixation member being pivotable between a first position in which the fixation member can apply a clamping force on the flat conductor, and a second position in which the fixation member applies no clamping force.

13. An electrical connection system as claimed in claim 1, further comprising an axially extending rib on the body of the electrical connector, and a corresponding axially extending slot in the bore of the housing means, the rib making a sliding fit in the slot.

14. An electrical connection system as claimed in claim 1, wherein the area on the upper contact surface is substantially convex.

15. An electrical connection system as claimed in claim 1, wherein the area on the upper contact surface comprises rows of resilient bumps.

16. An electrical connection system for a substantially flat electrical conductor comprising:

housing means having an axially extending housing bore;

an electrical connector having a body capable of making a sliding fit in the axial direction in the housing bore;

securing means on the housing means and the body for releasably securing the body in a predetermined position in the housing bore, wherein the body of the electrical connector further comprises a rear wall for receiving the flat conductor, a through bore through which the flat conductor can pass, an upper contact surface, a front edge around which the flat conductor can bend, and a lower surface, the through bore extending from an outer opening in the rear wall through the body in the axial direction to an inner opening, the upper contact surface extending in the axial direction away from the inner opening of the through bore, the upper contact surface having an area capable of exerting a force on the flat conductor in a direction substantially perpendicular to the axial direction and away from the upper contact surface, the area on the upper contact surface is formed of a different material to the body of the electrical connector, the front edge being disposed adjacent the upper contact surface and located between the upper contact surface and the lower surface, and the lower surface haying fastening means for securing a free end of the flat conductor.

17. An electrical connection system for a substantially flat electrical conductor comprising:

housing means having an axially extending housing bore the housing means being substantially tubular with the housing bore being open at either end;

an electrical connector having a body capable of making a sliding fit in the axial direction in the housing bore;

securing means on the housing means and the body for releasably securing the body in a predetermined position in the bore, wherein the body of the electrical connector further comprises a rear wall for receiving the flat conductor, a through bore through which the flat conductor can pass, an upper contact surface, a front edge around which the flat conductor can bend, and a lower surface, the through bore extending from an outer opening in the rear wall through the body in the axial direction to an inner opening, the upper contact surface extending in the axial direction away from the inner opening of the through bore, the upper contact surface having an area capable of exerting a force on the flat conductor in a direction substantially perpendicular to the axial direction and away from the upper contact surface, the front edge being disposed adjacent the upper contact surface and located between the upper contact surface and the lower surface, and the lower surface having fastening means for securing a free end of the flat conductor, wherein the system comprises two electrical connectors which are substantially identical, wherein the body of one electrical connector makes a sliding fit in the bore from one end thereof, and wherein the body of the other electrical connector makes a sliding fit in the bore from the other end thereof in a reverse orientation to the body of said one electrical connector such that the respective areas of the upper contact surfaces are positioned adjacent one another when each electrical connector is in its predetermined position.

18. An electrical connection system as claimed in claim 1, further comprising electrical terminals secured in the housing means, each terminal having a resilient contact surface such that the resilient contact surfaces are positioned adjacent the area of the upper contact surface when the electrical connector is in its predetermined position.

19. An electrical connection system for electrically connecting two substantially flat electrical conductors, the electrical connection system comprising:

a housing having an axially extending housing bore open at each end;

two electrical connectors, each of the two electrical connectors having a body; and securing members located on the housing and each of the bodies for releasably securing each of the bodies in a predetermined position in the housing bore, wherein each body comprising a rear wall for receiving a respective one of the flat conductors, a through bore through which said respective one of the flat conductors can pass, an upper contact surface, a front edge around which the respective one of the flat conductors can bend, and a lower surface, the through bore extending from an outer opening in the rear wall through the body in the axial direction to an inner opening, the upper contact surface extending in the axial direction away from the inner opening of the through bore, the upper contact surface having an area capable of exerting a force on the flat conductor in a direction substantially perpendicular to the axial direction and away from the upper contact surface, the front edge being disposed adjacent the upper contact surface and located between the upper contact surface and the lower surface, and the lower surface including a fastener for securing a free end of the respective one of the flat conductors, wherein the body of one electrical connector fits in the housing bore from one end thereof, and the body of the other electrical connector fits in the housing bore from the other end thereof in a reverse orientation to the body of the one electrical connector such that the respective areas of the upper contact surfaces are positioned to push the two flat conductors into electrical contact with one another when each electrical connector is in its predetermined position.

20. An electrical connection system for a substantially flat electrical conductor comprising:

a housing having an axially extending housing bore;

an electrical connector having a body capable of fitting in the axial direction in the housing bore;

securing members located on the body and the housing for securing the body in the housing bore;

a fastener attached to the body for securing a free end of the flat conductor, wherein the body of the electrical connector further comprising a rear wall for receiving the flat conductor, a through bore through which the flat conductor can pass, and a contact surface, the through bore extending from an outer opening in the rear wall through the body in the axial direction to an inner opening, the contact surface extending in the axial direction away from the inner opening of the through bore, the contact surface having an area capable of exerting a force on the flat conductor in a direction substantially perpendicular to the axial direction and away from the contact surface, wherein the electrical connection system further includes a fixation member attached to the rear wall by a binge to secure the flat conductor to the body.

21. An electrical connection system as claimed in claim 20, wherein the area on the contact surface is formed of a different material to the body of the electrical connector.

* * * * *